US006962486B2

(12) United States Patent
Lee et al.

(10) Patent No.: US 6,962,486 B2
(45) Date of Patent: Nov. 8, 2005

(54) VARIABLE CAPACITY ROTARY COMPRESSOR

(75) Inventors: Moon Joo Lee, Suwon (KR); Seung Kap Lee, Suwon (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 10/812,022

(22) Filed: Mar. 30, 2004

(65) Prior Publication Data

US 2005/0019190 A1 Jan. 27, 2005

(30) Foreign Application Priority Data

Jul. 23, 2003 (KR) ..... 10-2003-0050668

(51) Int. Cl.[7] ..... F04B 49/00

(52) U.S. Cl. ..... 417/218; 417/221; 417/223; 417/287; 417/410.3; 418/29; 418/60

(58) Field of Search ..... 418/60, 63, 69, 418/23, 29; 417/218, 221, 287, 298, 410.3, 417/223

(56) References Cited

U.S. PATENT DOCUMENTS

| | | | | |
|---|---|---|---|---|
| 4,236,874 A | | 12/1980 | Sisk | |
| 4,397,618 A | * | 8/1983 | Stenzel | 418/23 |
| 5,522,235 A | | 6/1996 | Matsuoka et al. | |
| 5,871,342 A | | 2/1999 | Harte et al. | |
| 5,951,261 A | | 9/1999 | Paczuski | |
| 6,092,993 A | | 7/2000 | Young et al. | |
| 6,132,177 A | | 10/2000 | Loprete et al. | |
| 6,190,137 B1 | | 2/2001 | Robbins et al. | |
| 6,796,773 B1 | * | 9/2004 | Choi et al. | 418/60 |
| 6,860,724 B2 | | 3/2005 | Cho et al. | |

FOREIGN PATENT DOCUMENTS

| | | | | |
|---|---|---|---|---|
| JP | 59063393 A | * | 4/1984 | F04C 29/08 |
| JP | 03281998 A | * | 12/1991 | F04C 29/10 |
| JP | 04143483 A | * | 5/1992 | F04C 23/00 |

* cited by examiner

*Primary Examiner*—Theresa Trieu
(74) *Attorney, Agent, or Firm*—Staas & Halsey LLP

(57) ABSTRACT

A variable capacity rotary compressor is designed to make a pressure of a high-pressure side be uniformly applied to upper and lower ends of a roller of a low-pressure side, allowing the roller of the low-pressure side to be smoothly rotated. The compressor includes a housing to define two compression chambers which are partitioned by a partition plate. Two flanges are mounted to predetermined positions of the compression chambers to close openings of the compression chambers. A rotating shaft passes through the compression chambers and the partition plate. Two eccentric units are mounted to the rotating shaft to be placed in the compression chambers. One of the eccentric units is eccentric from the rotating shaft to execute a compression operation while a remaining one of the eccentric units is released from eccentricity from the rotating shaft to execute an idle rotation, according to a rotating direction of the rotating shaft. Two rollers are fitted over the eccentric units, with inside portions of ends of the rollers being spaced apart from inside surfaces of the flanges, offsetting pressure applied to the ends of the rollers.

19 Claims, 8 Drawing Sheets

VARIABLE CAPACITY ROTARY COMPRESSOR

CROSS-REFERENCE TO RELATED APPLICATIONS

This application claims the benefit of Korean Application No. 2003-50668, filed Jul. 23, 2003, in the Korean Intellectual Property Office, the disclosure of which is incorporated herein by reference.

BACKGROUND OF THE INVENTION

1. Field of the Invention

The present invention relates, in general, to variable capacity rotary compressors and, more particularly, to a variable capacity rotary compressor, which is designed to apply a same pressure to upper and lower ends of a roller placed in a compression chamber having a lower pressure, thus allowing the roller to be smoothly rotated.

2. Description of the Related Art

Generally, a compressor is installed in a refrigeration system, such as an air conditioner and a refrigerator, which functions to cool air in a given space using a refrigeration cycle. In the refrigeration system, the compressor functions to compress a refrigerant which circulates through a refrigeration circuit of the refrigeration system. A cooling capacity of the refrigeration system is determined according to a compression capacity of the compressor. Thus, when the compressor is constructed to vary the compression capacity thereof as desired, the refrigeration system may be operated under an optimum condition, according to a difference between an environmental temperature and a preset reference temperature, thus allowing air in a given space to be efficiently cooled, and saving energy.

In the refrigeration system have been used a variety of compressors, for example, rotary compressors, reciprocating compressors, etc. The present invention relates to the rotary compressor, which will be described in the following.

The conventional rotary compressor includes a hermetic casing, with a stator and a rotor being installed in the hermetic casing. A rotating shaft penetrates through the rotor. An eccentric cam is integrally provided on an outer surface of the rotating shaft. A roller is provided in a compression chamber to be fitted over the eccentric cam. The rotary compressor constructed as described above is operated as follows. As the rotating shaft rotates, the eccentric cam and the roller execute eccentric rotation in the compression chamber. At this time, a gas refrigerant is drawn into the compression chamber and then compressed, prior to discharging the compressed refrigerant to an outside of the hermetic casing.

However, the conventional rotary compressor has a problem in that the rotary compressor is fixed in a compression capacity thereof, so that it is impossible to vary the compression capacity according to a difference between an environmental temperature and a preset reference temperature.

In a detailed description, when the environmental temperature is considerably higher than the preset reference temperature, the compressor must be operated in a large capacity compression mode to rapidly lower the environmental temperature. Meanwhile, when the difference between the environmental temperature and the preset reference temperature is not large, the compressor must be operated in a small capacity compression mode so as to save energy. However, it is impossible to change the capacity of the rotary compressor according to the difference between the environmental temperature and the preset reference temperature, so that the conventional rotary compressor does not efficiently cope with a variance in temperature, thus leading to a waste of energy.

SUMMARY OF THE INVENTION

Accordingly, it is an aspect of the present invention to provide a variable capacity rotary compressor, which is constructed so that a compression operation is executed in either of two compression chambers having different capacities, thus varying a compression capacity as desired.

It is another aspect of the present invention to provide a variable capacity rotary compressor, which is designed to make a pressure of a high-pressure side be uniformly applied to upper and lower ends of a roller of a low-pressure side, thus allowing the roller of the low-pressure side to be smoothly rotated.

Additional aspects and/or advantages of the invention will be set forth in part in the description which follows and, in part, will be obvious from the description, or may be learned by practice of the invention.

The above and/or other aspects are achieved by providing a variable capacity rotary compressor including a housing, a rotating shaft, first and second eccentric units, and first and second rollers. The housing defines first and second compression chambers therein which are partitioned by a partition plate. First and second flanges are mounted to predetermined positions of the first and second compression chambers to close openings of the first and second compression chambers, respectively. The rotating shaft passes through the first and second compression chambers and the partition plate. The first and second eccentric units are mounted to the rotating shaft to be placed in the first and second compression chambers, respectively. One of the first and second eccentric units is eccentric from the rotating shaft to execute a compression operation while a remaining one of the first and second eccentric units is released from eccentricity from the rotating shaft to execute an idle rotation according to a rotating direction of the rotating shaft. The first and second eccentric units are oppositely operated. The first and second rollers are fitted over the first and second eccentric units, respectively, with inside portions of ends of the first and second rollers being spaced apart from inside surfaces of the first and second flanges, respectively, thus offsetting pressure applied to the ends of the first and second rollers.

An annular depression is provided on the inside surface of each of the first and second flanges, thus allowing the first and second flanges to be spaced apart from the ends of the first and second rollers.

The partition plate has a through hole at a center thereof. The through hole has a larger diameter than the rotating shaft to allow the rotating shaft to pass through the partition plate, and the annular depression has an inner diameter equal to an inner diameter of the through hole.

The first and second eccentric units include first and second eccentric cams mounted to an outer surface of the rotating shaft to be placed in the first and second compression chambers, respectively, and first and second eccentric bushes rotatably fitted over the first and second eccentric cams, respectively, with the first and second rollers fitted over the first and second eccentric bushes, respectively. The first and second eccentric units also include a locking unit to make one of the first and second eccentric bushes be eccentric from the rotating shaft while making a remaining one of the first and second eccentric bushes be released from eccentricity from the rotating shaft, according to a rotating direction of the rotating shaft.

The compressor also includes a cylindrical connecting part to connect the first and second eccentric bushes to each other while the first and second eccentric bushes are eccentric in opposite directions. The locking unit includes a locking slot provided around the connecting part, and a locking pin mounted to the rotating shaft to engage with the locking slot.

BRIEF DESCRIPTION OF THE DRAWINGS

The above and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENTS

Figure 1:
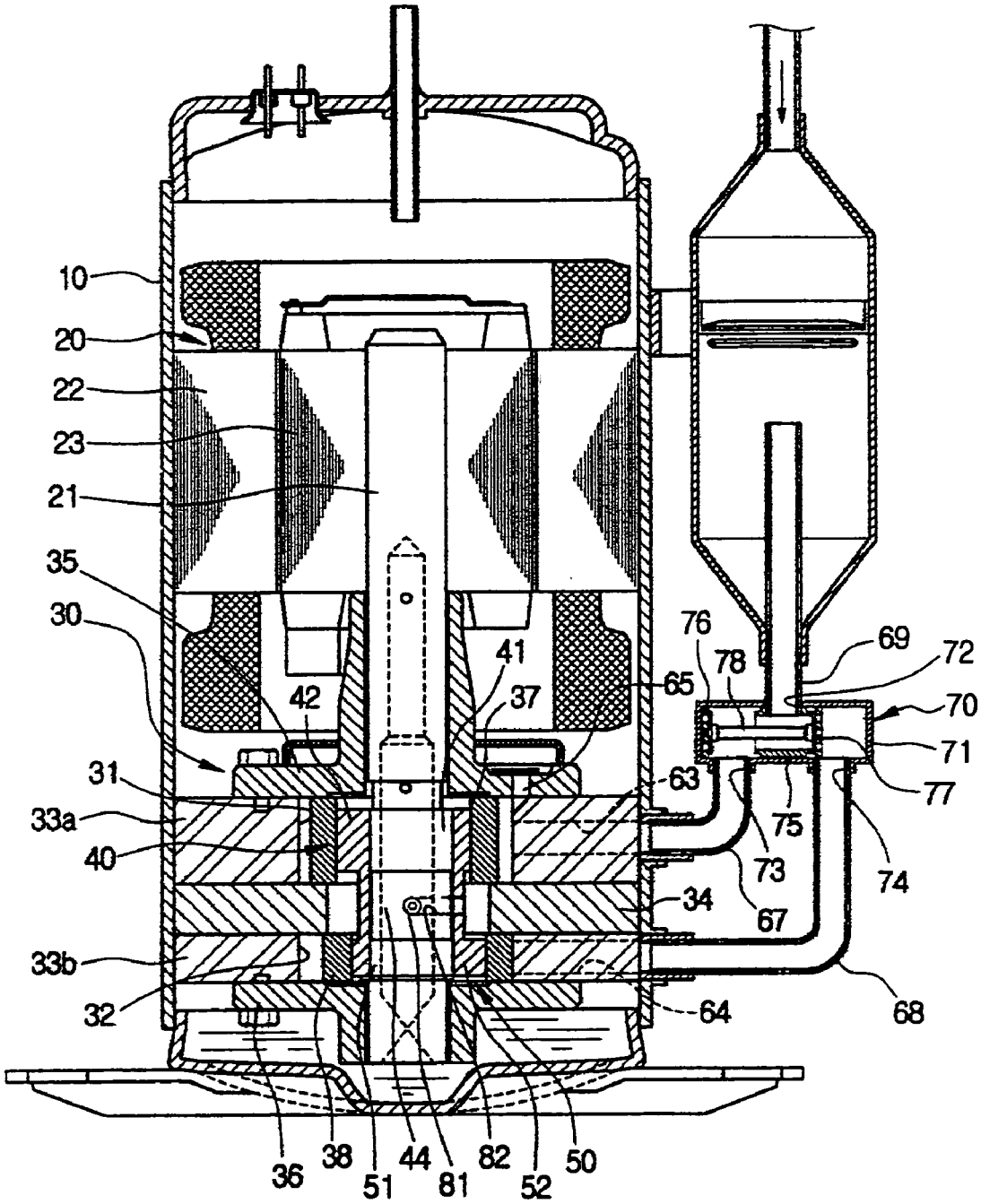
FIG. 1 is a sectional view illustrating a variable capacity rotary compressor, according to an embodiment of the present invention.

Reference will now be made in detail to the present preferred embodiments of the present invention, examples of which are illustrated in the accompanying drawings, wherein like reference numerals refer to like elements throughout.

As illustrated in FIG. 1, a variable capacity rotary compressor according to the present invention includes a hermetic casing 10. A drive unit 20 is installed in the casing 10 to be placed on an upper portion of the casing 10, and generates a rotating force. A compressing unit 30 is installed in the casing 10 to be placed on a lower portion of the casing 10, and is connected to the drive unit 20 through a rotating shaft 21. The drive unit 20 includes a cylindrical stator 22, and a rotor 23. The stator 22 is mounted to an inner surface of the casing 10. The rotor 23 is rotatably and concentrically set in the stator 22, and is mounted to the rotating shaft 21 which is placed at a center of the casing 10. The drive unit 20 rotates the rotating shaft 21 forwards or backwards.

The compressing unit 30 includes upper and lower housings 33*a* and 33*b* which define first and second compression chambers 31 and 32, respectively. The first and second compression chambers 31 and 32 are both cylindrical but have different capacities. An upper flange 35 is mounted to an upper surface of the upper housing 33*a* to close an upper portion of the first compression chamber 31, and a lower flange 36 is mounted to a lower surface of the lower housing 33*b* to close a lower portion of the second compression chamber 32. Further, the upper and lower flanges 35 and 36 function to rotatably support the rotating shaft 21. A partition plate 34 is interposed between the upper and lower housings 33*a* and 33*b* to partition the first and second compression chambers 31 and 32 into each other.

As illustrated in FIGS. 1 through 4, first and second eccentric units 40 and 50 are mounted to the rotating shaft 21 to be placed in the first and second compression chambers 31 and 32, respectively. First and second rollers 37 and 38 are rotatably fitted over the first and second eccentric units 40 and 50, respectively. Further, a first vane 61 is installed between an inlet port 63 and an outlet port 65 of the first compression chamber 31, and reciprocates in a radial direction while being in contact with an outer surface of the first roller 37, thus performing a compression operation. A second vane 62 is installed between an inlet port 64 and an outlet port 66 of the second compression chamber 32, and reciprocates in a radial direction while being in contact with an outer surface of the second roller 38, thus performing a compression operation. The first and second vanes 61 and 62 are biased by vane springs 61*a* and 62*a*, respectively. Further, the inlet and outlet ports 63 and 65 of the first compression chamber 31 are arranged on opposite sides of the first vane 61. Similarly, the inlet and outlet ports 64 and 66 of the second compression chamber 32 are arranged on opposite sides of the second vane 62. Although not shown in the drawings in detail, the first and second outlet ports 65 and 66 communicate with an interior of the hermetic casing 10 through a path defined in the housing.

Figure 2:
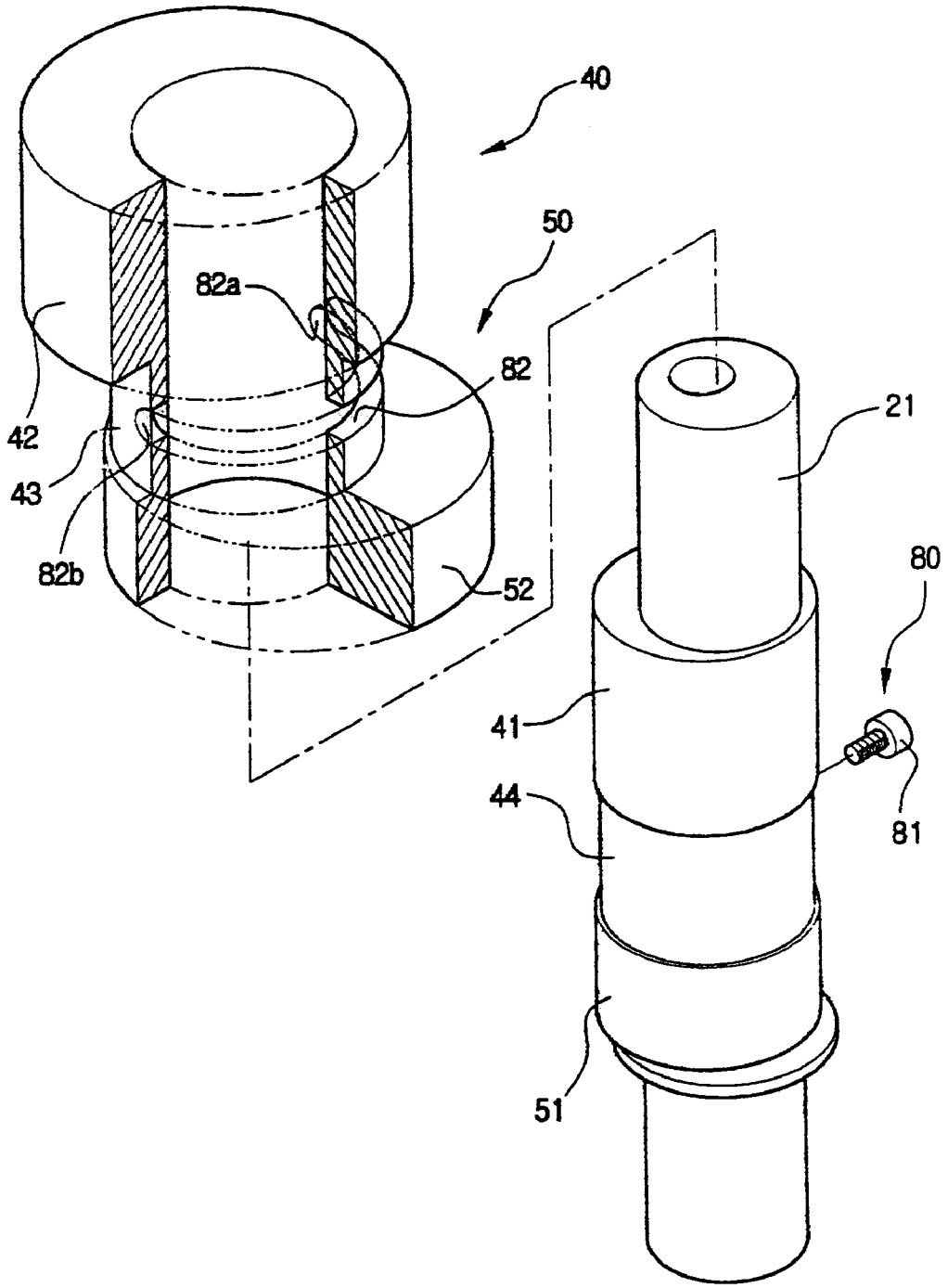
FIG. 2 is an exploded perspective view of an eccentric unit included in the variable capacity rotary compressor of FIG. 1.

The first and second eccentric units 40 and 50 include first and second eccentric cams 41 and 51, respectively. The first and second eccentric cams 41 and 51 are mounted to an outer surface of the rotating shaft 21 to be placed in the first and second compression chambers 31 and 32, respectively, while being eccentric from the rotating shaft 21 in a same direction. First and second eccentric bushes 42 and 52 are rotatably fitted over the first and second eccentric cams 41 and 51, respectively. As illustrated in FIG. 2, the first and second eccentric bushes 42 and 52 are integrally connected to each other by a cylindrical connecting part 43, and are eccentric from the rotating shaft 21 in opposite directions. Further, the first and second rollers 37 and 38 are rotatably fitted over the first and second eccentric bushes 42 and 52, respectively.

Figure 3:
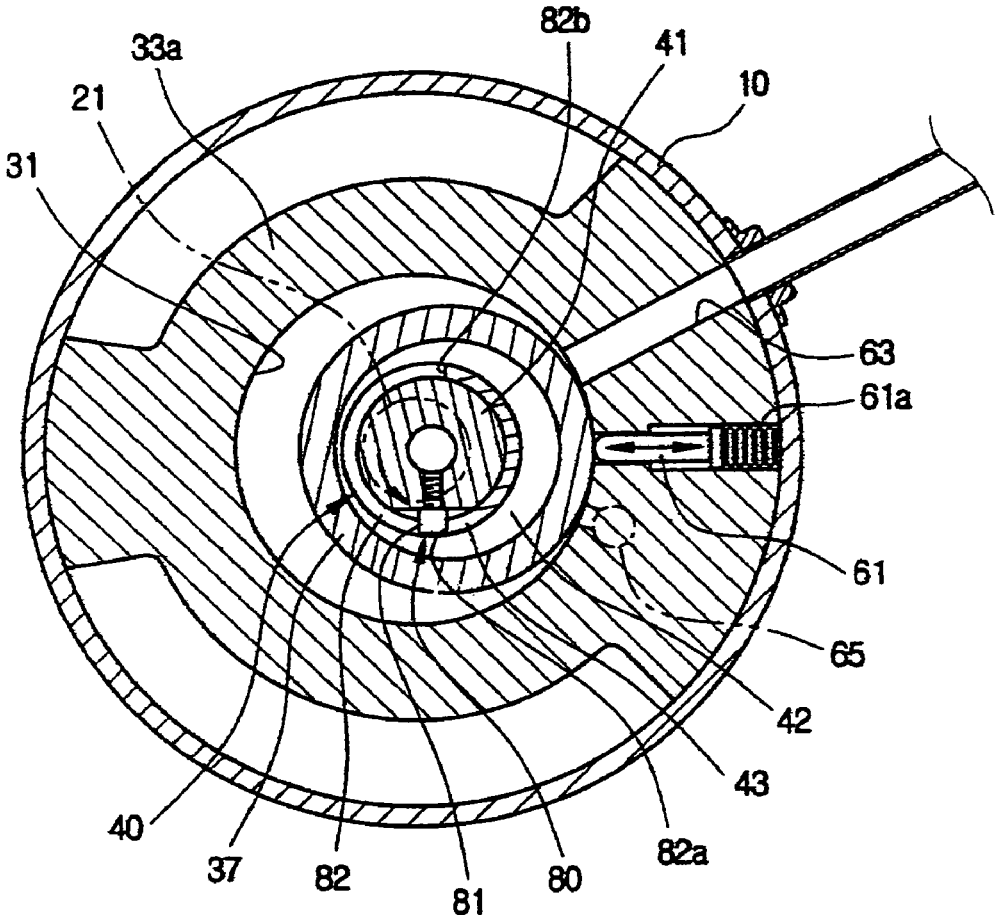
FIG. 3 is a sectional view illustrating a compression operation of a first compression chamber, when a rotating shaft of the variable capacity rotary compressor of FIG. 1 is rotated in a first direction.

As illustrated in FIGS. 2 and 3, an eccentric part 44 is mounted to the outer surface of the rotating shaft 21 between the first and second eccentric cams 41 and 51 to be eccentric from the rotating shaft 21 in a same direction of the eccentric cams 41 and 51. A locking unit 80 is mounted to the eccentric part 44. In this case, the locking unit 80 functions to make one of the first and second eccentric bushes 42 and 52 be eccentric from the rotating shaft 21 while making a remaining one of the first and second eccentric bushes 42 and 52 be released from eccentricity from the rotating shaft 21, according to a rotating direction of the rotating shaft 21. The locking unit 80 includes a locking pin 81 and a locking slot 82. The locking pin 81 is mounted to a flat surface of the eccentric part 44 in a screw-type fastening method to be projected from the flat surface of the eccentric part 44. The locking slot 82 is provided around a part of the connecting part 43 which connects the first and second eccentric bushes 42 and 52 to each other. The locking pin 81 engages with the locking slot 82 to make one of the first and second eccentric bushes 42 and 52 be eccentric from the rotating shaft 21 while a remaining one of the first and second eccentric bushes 42 and 52 be released from eccentricity from the rotating shaft 21, according to a rotating direction of the rotating shaft 21.

That is, when the rotating shaft 21 is rotated while the locking pin 81 mounted to the eccentric part 44 of the rotating shaft 21 engages with the locking slot 82 of the connecting part 43, the locking pin 81 is rotated within the locking slot 82 to be locked by either of locking parts 82*a* and 82*b* which are provided at opposite ends of the locking slot 82, thus making the first and second eccentric bushes 42 and 52 be rotated along with the rotating shaft 21. Further, when the locking pin 81 is locked by either of the locking parts 82*a* and 82*b* of the locking slot 82, one of the first and second eccentric bushes 42 and 52 is eccentric from the rotating shaft 21 and a remaining one of the first and second eccentric bushes 42 and 52 is released from eccentricity from the rotating shaft 21, thus executing a compression operation in one of the first and second compression chambers 31 and 32 and executing an idle operation in a remaining one of the first and second eccentric bushes 42 and 52. On the other hand, when a rotating direction of the rotating shaft 21 is changed, the first and second eccentric bushes 42 and 52 are arranged oppositely to the above-mentioned state.

Figure 7:
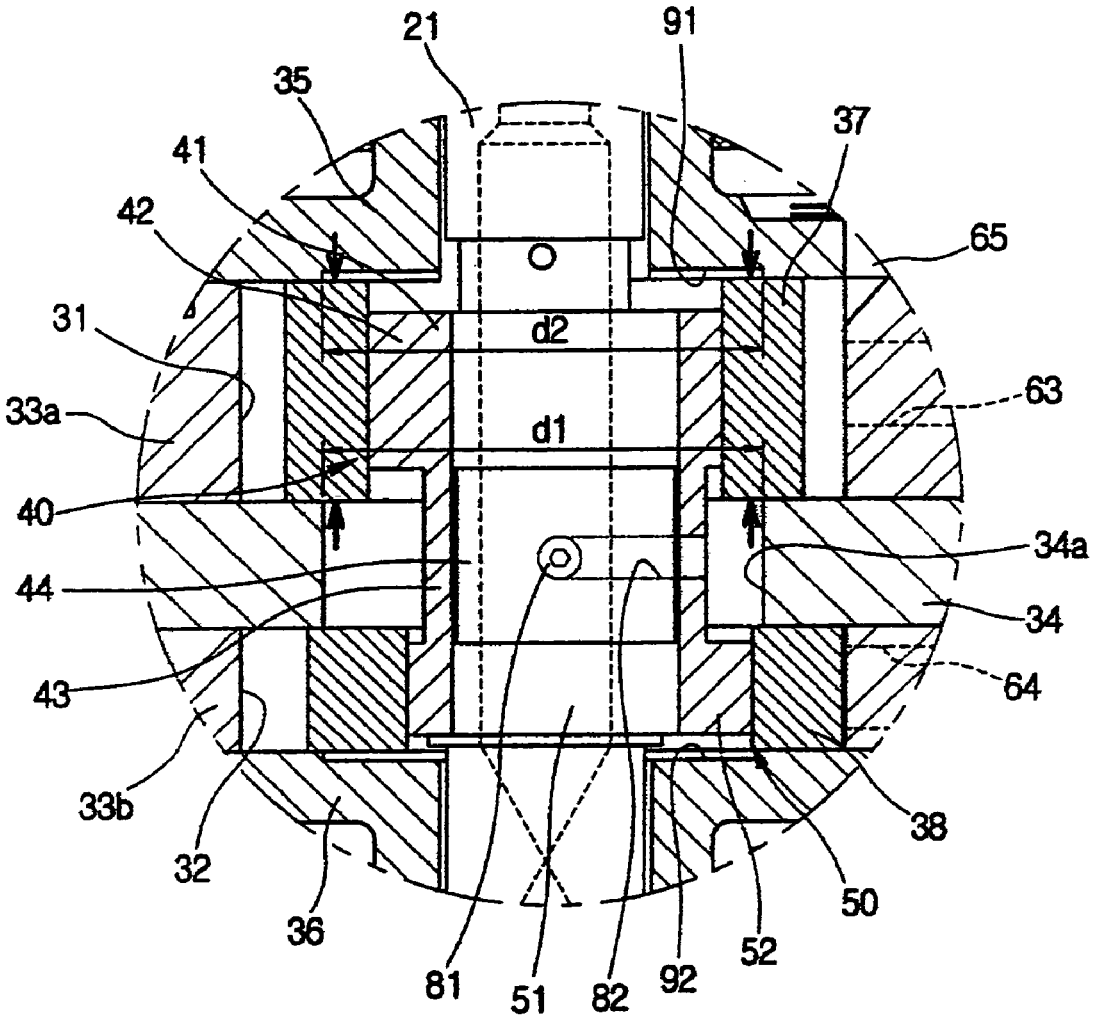
FIG. 7 is a sectional view illustrating the idle rotation of the first compression chamber when the rotating shaft of the variable capacity rotary compressor is rotated in the second direction, in which a pressure applied to an upper portion of a first roller is equal to a pressure applied to a lower portion of the first roller.

According to the variable capacity rotary compressor of FIG. 7, an inside portion of an upper end of the first roller 37 is spaced apart from an inside surface of the upper flange 35. Meanwhile, an inside portion of a lower end of the second roller 38 is spaced apart from an inside surface of the lower flange 36, thus preventing an occurrence of a pressure difference between an upper portion of the roller 37 or 38 on the low-pressure side and a lower portion of the roller 37 or 38 by a pressure which is applied from a high-pressure side where the compression operation is executed to a low-pressure side where the idle rotation is executed. That is, the first roller 37 is rotated while only an outside portion of the upper end of the first roller 37 is in contact with the upper flange 35. Similarly, the second roller 38 is rotated while only an outside portion of the lower end of the second roller 38 being in contact with the lower flange 36. Thus, the compressor of the present invention allows an axial pressure to act on the upper end of the first roller 37 and the lower end of the second roller 38. An upper annular depression 91 is formed on the inside surface of the upper flange 35 to make the inside surface of the upper flange 35 be spaced apart from the inside portion of the upper end of the first roller 37. Meanwhile, a lower annular depression 92 is formed on the inside surface of the lower flange 36 to make the inside surface of the lower flange 36 be spaced apart from the inside portion of the lower end of the second roller 38. Further, a through hole 34*a* is provided at a center of the partition plate 34 to allow the rotating shaft 21 to pass through the partition plate 34. In this case, an inner diameter d2 of each of the upper and lower annular depressions 91 and 92 is equal to an inner diameter d1 of the through hole 34*a*.

Figure 8:
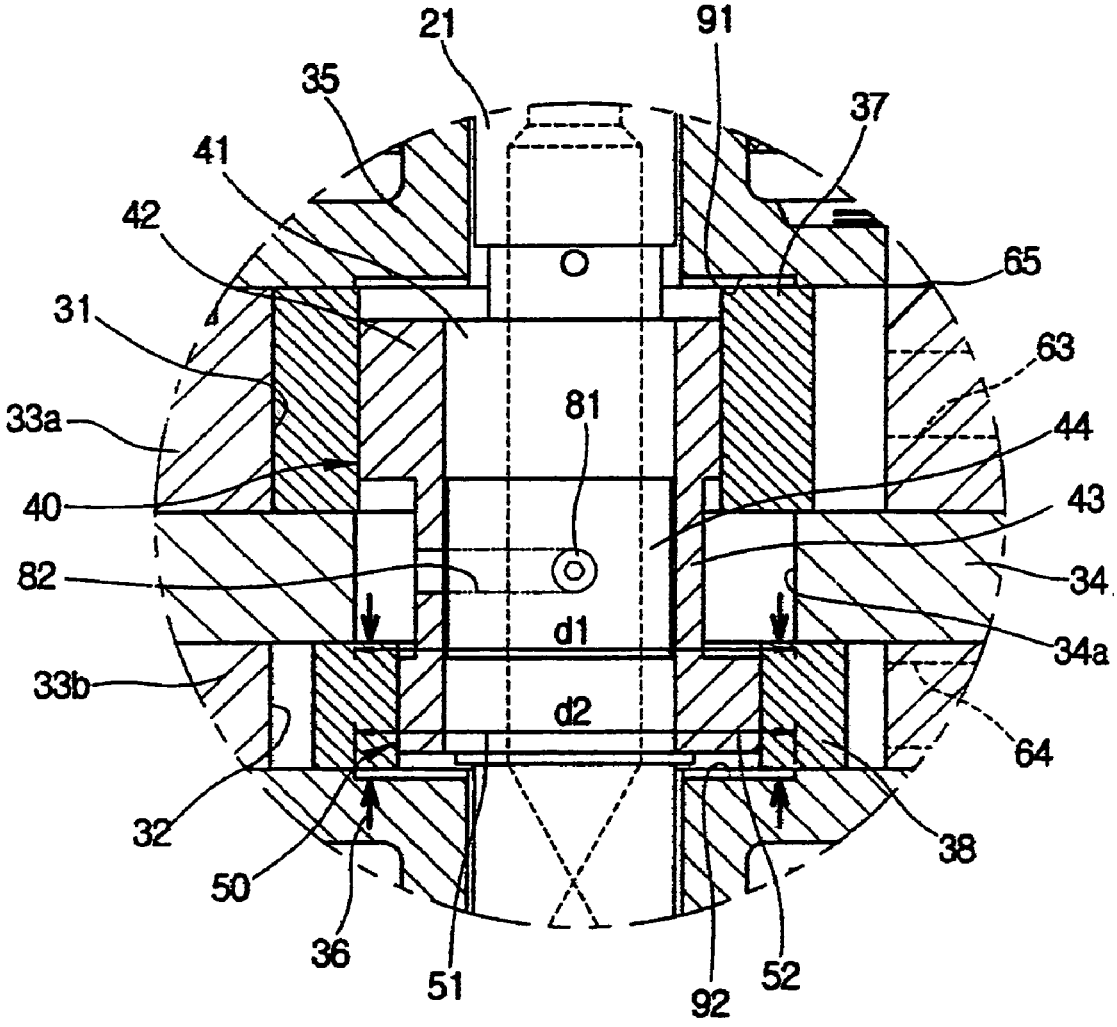
FIG. 8 is a sectional view illustrating the idle rotation of the second compression chamber when the rotating shaft of the variable capacity rotary compressor is rotated in the first direction, in which a pressure applied to an upper portion of a second roller is equal to a pressure applied to a lower portion of the second roller.

As illustrated in FIG. 7, when a pressure is applied from the second compression chamber 32, where the compression operation is executed, to the first compression chamber 31, where the idle rotation is executed, an axial pressure applied to the lower end of the first roller 37 executing the idle rotation is offset by an axial pressure which is generated by the upper annular depression 91. Thus, the first roller 37 is smoothly rotated without being biased to the upper flange 35 or being inclined. Since the inner diameter d2 of each of the upper and lower annular depressions 91 and 92 is equal to the inner diameter d1 of the through hole 34*a* of the partition plate 34, an area of the lower end of the first roller 37 to which the axial pressure acts is equal to an area of the upper end of the first roller 37, thus allowing the axial pressure applied to the lower end of the first roller 37 to be equal to the axial pressure applied to the upper end of the first roller 37. FIG. 8 illustrates the case where the compression operation is executed in the first compression chamber 31 and the idle rotation is executed in the second compression chamber 32.

As illustrated in FIG. 1, the variable capacity rotary compressor according to the present invention also includes a path control unit 70. The path control unit 70 controls a refrigerant intake path to make a refrigerant fed from a refrigerant inlet pipe 69, be drawn into the inlet port 63 of the first compression chamber 31 or the inlet port 64 of the second compression chamber 32 (that is, the inlet port of a compression chamber where the compression operation is executed).

The path control unit 70 includes a hollow cylindrical body 71, and a valve unit installed in the body 71. An inlet 72 is provided at a central portion of the body 71 to be connected to the refrigerant inlet pipe 69. First and second outlets 73 and 74 are provided on opposite sides of the body 71. Two pipes 67 and 68, which are connected to the inlet port 63 of the first compression chamber 31 and the inlet port 64 of the second compression chamber 32, respectively, are connected to the first and second outlets 73 and 74, respectively. Further, the valve unit includes a valve seat 75, first and second valve members 76 and 77, and a connecting member 78. The valve seat 75 has a cylindrical shape, and is opened at both ends thereof. The first and second valve members 76 and 77 are installed on both sides in the body 71, and axially reciprocate in the body 71 to open or close both ends of the valve seat 75. The connecting member 78 connects the first and second valve members 76 and 77 to each other to allow the first and second valve members 76 and 77 to move together. In light of the above configuration, the path control unit 70 is operated as follows.

When the compression operation is executed in either of the first and second compression chambers 31 and 32, the first and second valve members 77 set in the body 71 move in a direction toward one of the two outlets 73 and 74 having a lower pressure due to a difference in pressure between the two outlets 73 and 74, thus automatically changing the refrigerant intake path. For example, the refrigerant intake path is formed to draw the refrigerant into the inlet port of a compression chamber where the compression operation is executed.

The operation of the variable capacity rotary compressor according to the present invention will be described below.

Figure 4:
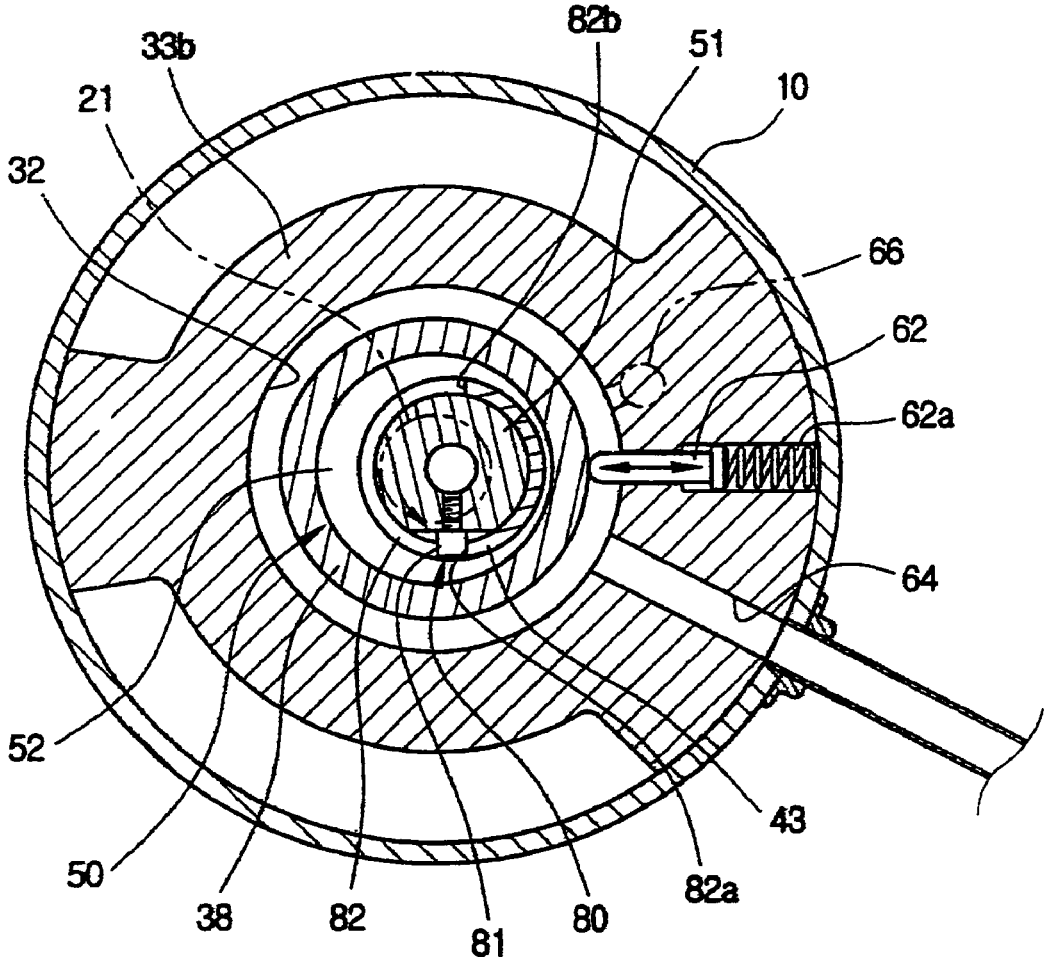
FIG. 4 is a sectional view illustrating an idle operation of a second compression chamber, when the rotating shaft of the variable capacity rotary compressor of FIG. 1 is rotated in the first direction.

As illustrated in FIG. 3, when the rotating shaft 21 is rotated in a direction, an outer surface of the first eccentric bush 42 in the first compression chamber 31 is eccentric from the rotating shaft 21 and the locking pin 81 is locked by the locking part 82*a* of the locking slot 82. Thus, the first roller 37 is rotated while coming into contact with an inner surface of the first compression chamber 31, thus executing the compression operation in the first compression chamber 31. At this time, the second eccentric bush 52 is arranged in the second compression chamber 32 as illustrated in FIG. 4. That is, an outer surface of the second eccentric bush 52, which is eccentric in a direction opposite to the first eccentric bush 42, is concentric with the rotating shaft 21, and the second roller 38 is spaced apart from an inner surface of the second compression chamber 32, thus an idle rotation is executed in the second compression chamber 32. Further, when the compression operation is executed in the first compression chamber 31, the refrigerant is drawn into the inlet port 63 of the first compression chamber 31. In this case, the path control unit 70 controls the refrigerant intake path to draw the refrigerant into the first compression chamber 31.

The compressor of the present invention is operated as described above, because the first and second eccentric cams 41 and 51 are eccentric from the rotating shaft 21 in a same direction while the first and second eccentric bushes 42 and 52 are eccentric from the rotating shaft 21 in opposite directions. That is, when a maximum eccentric part of the first eccentric cam 41 and a maximum eccentric part of the first eccentric bush 42 are arranged in a same direction, a maximum eccentric part of the second eccentric cam 51 and a maximum eccentric part of the second eccentric bush 52 are arranged in opposite directions, thus allowing the compressor of the present invention to be operated as described above.

When the compression operation is executed in the first compression chamber 31 and the idle rotation is executed in the second compression chamber 32, as illustrated in FIG. 8, a pressure is applied from the first compression chamber 31 having a high pressure to the second compression chamber 32 having a low pressure, and acts on the upper end of the second roller 38 which is placed in the second compression chamber 32. In this case, an axial pressure acts on the inside portion of the upper end of the second roller 38 through the through hole 34*a* which is provided at the partition plate 34, while an axial pressure acts on the inside portion of the lower end of the second roller 38 through the lower annular depression 92 of the lower flange 36. Therefore, the pressure having a same magnitude acts on the upper and lower ends of the second roller 38, and the pressure applied to the upper end of the second roller 38 is offset by the pressure applied to the lower end of the second roller 38. As a result, the second roller 38 is smoothly rotated without coming into close contact with the lower flange 36 or being inclined.

Figure 5:
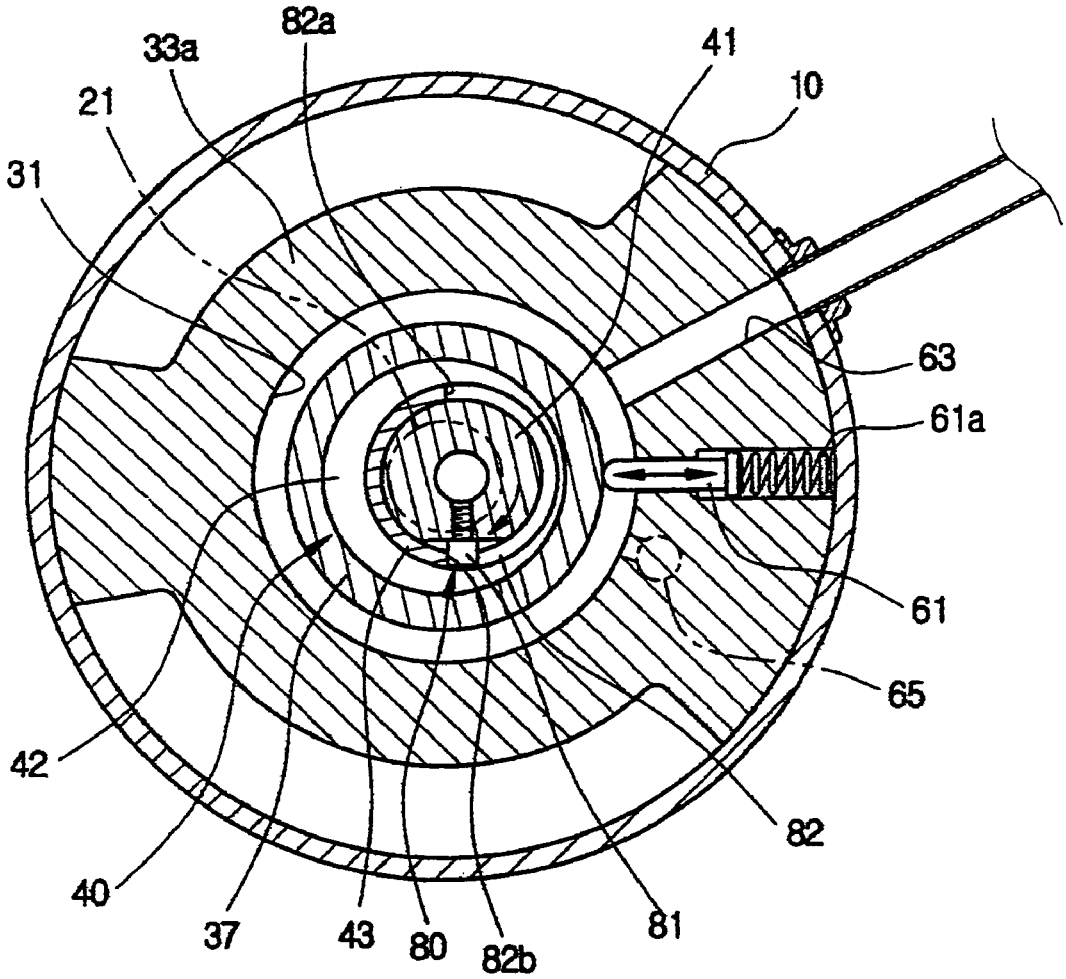
FIG. 5 is a sectional view illustrating an idle operation of the first compression chamber, when the rotating shaft of the variable capacity rotary compressor of FIG. 1 is rotated in a second direction.
Figure 6:
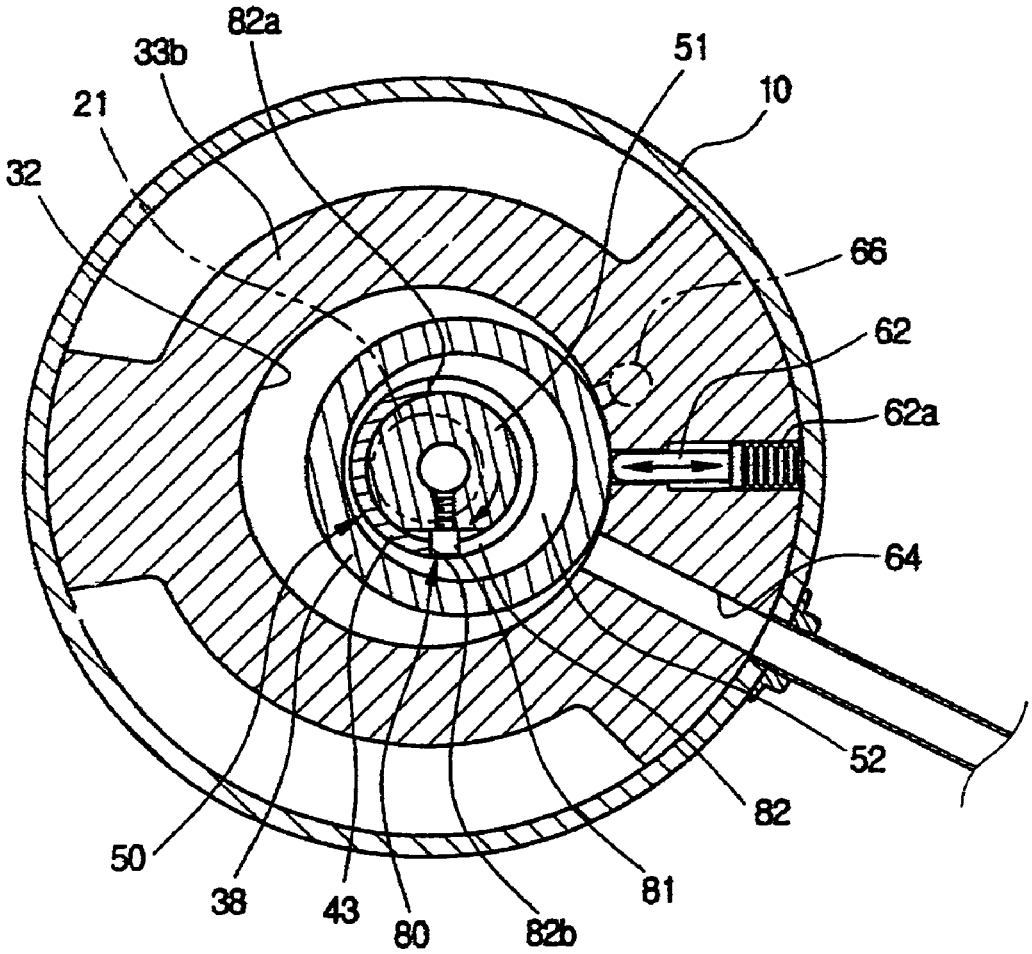
FIG. 6 is a sectional view illustrating a compression operation of the second compression chamber, when the rotating shaft of the variable capacity rotary compressor of FIG. 1 is rotated in the second direction.

When the rotating shaft 21 is rotated in a direction opposite to the direction of FIG. 3, as illustrated in FIG. 5, the outer surface of the first eccentric bush 42 which is placed in the first compression chamber 31 is released from eccentricity from the rotating shaft 21, and the locking pin 81 is locked by the locking part 82*b* of the locking slot 82. Thus, the first roller 37 is rotated while being spaced apart from the inner surface of the first compression chamber 31, and the idle rotation is executed in the first compression chamber 31. Meanwhile, in the second compression chamber 32, as illustrated in FIG. 6, the outer surface of the second eccentric bush 52 is eccentric from the rotating shaft 21, and the second roller 38 is rotated while being in contact with the inner surface of the second compression chamber 32, thus the compression operation is executed in the second compression chamber 32.

When the compression operation is executed in the second compression chamber 32, the path control unit 70 controls the refrigerant intake path to draw the refrigerant into the inlet port 64 of the second compression chamber 32. When the compression operation is executed in the second compression chamber 32 and the idle rotation is executed in the first compression chamber 31, as illustrated in FIG. 7, a pressure is applied from the second compression chamber 32 having a high pressure to the first compression chamber 31 having a low pressure, and acts on the lower end of the first roller 37 which is placed in the first compression chamber 31. In this case, the axial pressure acts on the inside portion of the lower end of the first roller 37 through the through hole 34*a* which is provided at the partition plate 34, while the axial pressure acts on the inside portion of the upper end of the first roller 37 through the upper annular depression 91 of the upper flange 35. Therefore, the pressure having a same magnitude acts on the upper and lower ends of the first roller 37, thus the pressure applied to the upper end of the first roller 37 is offset by the pressure applied to the lower end of the first roller 37. As a result, the first roller 37 is smoothly rotated without coming into close contact with the upper flange 35 or being inclined.

As is apparent from the above description, the present invention provides a variable capacity rotary compressor, which is designed to execute a compression operation in either of first and second compression chambers having different capacities by an eccentric unit which rotates in the first or second direction, thus varying a compression capacity of the compressor as desired.

Further, the present invention provides a variable capacity rotary compressor, which is designed to make a pressure of a high-pressure side be applied to an end of a roller of a low-pressure side through an annular depression formed on an inside surface of each of upper and lower flanges. Thus, pressure of an equal magnitude is applied to upper and lower ends of the roller executing an idle rotation, so that the pressure applied to the upper end of the roller is offset by the pressure applied to the lower end of the roller. Therefore, the roller executing the idle rotation is prevented from coming into close contact with the upper or lower flange, or being inclined. As a result, the roller executing the idle rotation is smoothly rotated.

Although a preferred embodiment of the present invention has been shown and described, it would be appreciated by those skilled in the art that changes may be made in these embodiments without departing from the principles and spirit of the invention, the scope of which is defined in the claims and their equivalents.

What is claimed is:

1. A variable capacity rotary compressor, comprising:

a partition plate;

a housing installed in a hermetic casing, to define first and second compression chambers therein which are partitioned by the partition plate;

first and second flanges mounted to predetermined positions of the first and second compression chambers, to close openings of the first and second compression chambers, respectively;

a rotating shaft to pass through the first and second compression chambers and the partition plate;

first and second eccentric units mounted to the rotating shaft, to be placed in the first and second compression chambers, respectively, one of the first and second eccentric units being eccentric from the rotating shaft to execute a compression operation while a remaining one of the first and second eccentric units is released from eccentricity from the rotating shaft to execute an idle rotation according to a rotating direction of the rotating shaft, the first and second eccentric units being oppositely operated; and first and second rollers to fit over the first and second eccentric units, respectively, with inside portions of ends of the first and second rollers being spaced apart from inside surfaces of the first and second flanges, respectively, offsetting pressure applied to the ends of the first and second rollers.

2. The rotary compressor according to claim 1, further comprising:

an annular depression provided on the inside surface of each of the first and second flanges, allowing the first and second flanges to be spaced apart from the ends of the first and second rollers.

3. The rotary compressor according to claim 2, wherein the partition plate comprises:

a through hole at a center thereof, and having a larger diameter than the rotating shaft, to allow the rotating shaft to pass through the partition plate, wherein the annular depression has an inner diameter equal to an inner diameter of the through hole.

4. The rotary compressor according to claim 1, wherein the first and second eccentric units comprise:

first and second eccentric cams mounted to an outer surface of the rotating shaft to be placed in the first and second compression chambers, respectively;

first and second eccentric bushes to rotatably fit over the first and second eccentric cams, respectively, with the first and second rollers fitted over the first and second eccentric bushes, respectively; and a locking unit to make one of the first and second eccentric bushes be eccentric from the rotating shaft while making a remaining one of the first and second eccentric bushes be released from eccentricity from the rotating shaft, according to a rotating direction of the rotating shaft.

5. The rotary compressor according to claim 4, further comprising:

a cylindrical connecting part to connect the first and second eccentric bushes to each other while the first and second eccentric bushes are eccentric in opposite directions; and an eccentric part mounted to the outer surface of the rotating shaft between the first and second eccentric cams to be eccentric from the rotating shaft in a same direction of the first and second eccentric cams.

6. The rotary compressor according to claim 5, wherein the locking unit comprises:

a locking slot provided around the cylindrical connecting part; and a locking pin mounted to the eccentric part of the rotating shaft to engage with the locking slot.

7. The rotary compressor according to claim 6, wherein the locking pin is mounted to a flat surface of the eccentric part via a screw-type fastening to project from the flat surface of the eccentric part.

8. The rotary compressor according to claim 7, wherein the locking pin engages with the locking slot to make one of the first and second eccentric bushes be eccentric from the rotating shaft, while a remaining one of the first and second eccentric bushes are released from eccentricity from the rotating shaft, according to a rotating direction of the rotating shaft.

9. The rotary compressor according to claim 8, further comprising:

locking parts provided at opposite ends of the locking slot, wherein when the rotating shaft is rotated while the locking pin mounted to the eccentric part of the rotating shaft engages with the locking slot, the locking pin is rotated within the locking slot to be locked by at least one of the locking parts.

10. The rotary compressor according to claim 9, wherein when the locking pin is locked by at least one of the locking parts of the locking slot, one of the first and second eccentric bushes is eccentric from the rotating shaft and a remaining one of the first and second eccentric bushes is released from eccentricity from the rotating shaft, allowing a compression operation to be executed in one of the first and second compression chambers and an idle operation to be executed in a remaining one of the first and second compression chambers.

11. The rotary compressor according to claim 4, further comprising:

a first vane installed between an inlet port and an outlet port of the first compression chamber, to reciprocate in a radial direction while being in contact with an outer surface of the first roller;

a second vane installed between an inlet port and an outlet port of the second compression chamber, to reciprocate in a radial direction while being in contact with an outer surface of the second roller; and first and second vane springs to bias the first and second vanes, respectively, wherein the inlet and outlet ports of the first compression chamber are arranged on opposite sides of the first vane, and the inlet and outlet ports of the second compression chamber are arranged on opposite sides of the second vane.

12. The rotary compressor according to claim 11, wherein the outlet ports of the first and second compression chambers communicate with an interior of the hermetic casing through a path defined in the housing.

13. The rotary compressor according to claim 1, further comprising:

a path control unit to control a refrigerant intake path to make a refrigerant fed from a refrigerant inlet pipe be drawn into an inlet port of the first compression chamber or an inlet port of the second compression chamber.

14. The rotary compressor according to claim 13, wherein the path control unit comprises:

a hollow cylindrical body;

a valve unit installed in the hollow cylindrical body;

an inlet provided at the body, to be connected to the refrigerant inlet pipe;

first and second outlets provided on opposite sides of the body; and two pipes connected to the inlet port of the first compression chamber and the inlet port of the second compression chamber, respectively, and connected to the first and second outlets, respectively.

15. The rotary compressor according to claim 14, wherein the valve unit comprises:

a valve seat having a cylindrical shape and opened at both ends thereof;

first and second valve members installed on both sides of the hollow cylindrical body, to axially reciprocate in the body to open or close both ends of the valve seat; and a connecting member to connect the first and second valve member to each other, to allow the first and second valve members to move together.

16. The rotary compressor according to claim 15, wherein when a compression operation is executed in either of the first or second chambers, the first and second valve members set in the hollow cylindrical body move in a direction toward one of the first and second outlets having a lower pressure due to a difference in pressure between the first and second outlets, automatically changing the refrigerant intake path.

17. The rotary compressor according to claim 1, wherein the first roller is rotated while an outside portion of an upper end of the first roller is in contact with the first flange, and the second roller is rotated while an outside portion of a lower end of the second roller is in contact with the second flange, allowing an axial pressure to act on the upper end of the first roller and the lower end of the second roller.

18. A variable capacity rotary compressor, comprising:

a partition plate;

a housing to define first and second compression chambers therein which are partitioned by the partition plate;

first and second flanges mounted to predetermined positions of the first and second compression chambers, to close openings of the first and second compression chambers, respectively;

a rotating shaft to pass through the first and second compression chambers and the partition plate;

first and second eccentric units mounted to the rotating shaft, to be placed in the first and second compression chambers, respectively, one of the first and second eccentric units being eccentric from the rotating shaft to execute a compression operation while a remaining one of the first and second eccentric units is released from eccentricity from the rotating shaft to execute an idle rotation according to a rotating direction of the rotating shaft, the first and second eccentric units being oppositely operated; and first and second rollers to fit over the first and second eccentric units, respectively, with inside portions of ends of the first and second rollers being spaced apart from inside surfaces of the first and second flanges, respectively, offsetting pressure applied to upper and lower ends of the one of the first and second rollers executing an idle rotation.

19. The rotary compressor according to claim 18, wherein a pressure of an equal magnitude is applied to the upper and lower ends of the one of the first and second rollers executing the idle rotation, so that the pressure applied to the upper end of the roller is offset by the pressure applied to the lower end of the roller, preventing the roller from coming into contact with the first or second flange or being inclined.

* * * * *